United States Patent [19]

Wilson

[11] Patent Number: 4,930,771

[45] Date of Patent: Jun. 5, 1990

[54] DEVICE FOR EXERCISING THE MID-BODY REGION

[76] Inventor: Charlie Wilson, 501 W. 25th St., Riviera Beach, Fla. 33404

[21] Appl. No.: 407,288

[22] Filed: Sep. 14, 1989

[51] Int. Cl.[5] ..... A63B 21/00

[52] U.S. Cl. ..... 272/146; 272/134; 272/144

[58] Field of Search ..... 272/146, 144, 109, 93, 272/126, 128, 134, 73, 145, 96, 28 R, 28 S, 116, 118; 297/1, 464

[56] References Cited

U.S. PATENT DOCUMENTS 4,673,180 6/1987 Rice ..... 272/146

4,789,152 12/1988 Guerra ..... 272/144

4,836,530 6/1989 Stanley ..... 272/146

FOREIGN PATENT DOCUMENTS 2163358 2/1986 United Kingdom ..... 272/134

*Primary Examiner*—Stephen R. Crow

*Attorney, Agent, or Firm*—Norman B. Rainer

[57] ABSTRACT

A twist board exercising device is provided which permits the exercising person to be seated upon a stool within a framework of adjustable height. Opposed arm rests and associated hand grips enable the person to limit the amount of twisting movement. A backrest portion, joined to the framework, is adjustably positionable with respect to elevation and angle of inclination.

4 Claims, 1 Drawing Sheet

DEVICE FOR EXERCISING THE MID-BODY REGION

BACKGROUND OF THE INVENTION

This invention relates to improvements in an exercise device of the twist board type, and more particularly concerns a twist board exercising device which focuses stress forces upon the mid-section of the user.

Numerous exercise devices have been disclosed having a horizontally disposed rotatable platform adapted for the user to stand upon. In use, the person standing upon the platform executes twisting movement in repetitively opposite directions about the vertical axis of the torso Such motion subjects the body muscles to cyclical tensioning and relaxing conditions which improves muscle tone and diminishes the amount of associated 5 fatty tissue.

In certain earlier devices, the effectiveness of the twist board principle is diminished because the twisting force is widely distributed instead of being concentrated into desired regions of the user's body. Earlier devices have also in some instances been difficult to use by persons with certain physical impairments such as knee problems From a safety standpoint, insufficient consideration has earlier been devoted to preventing the exercising person from falling from the platform, or sustaining overstressing injury by uncontrollable extremes of rotation.

It is accordingly an object of the present invention to provide an exercise device utilizing a rotatable platform It is another object of this invention to provide a device as in the foregoing object for exercising the mid-body region by repetitive twisting movement in alternating directions It is a further object of the present invention to provide a device of the aforesaid nature which does not require the user to stand erect.

it is a still further object of this invention to provide a device of the aforesaid nature which safely restrains the user and permits the user to control the extent of twisting motion.

It is yet another object of the present invention to provide a device of the aforesaid nature of rugged, durable construction amenable to low cost manufacture.

These objects and other objects and advantages of the invention will be apparent from the following description.

SUMMARY OF THE INVENTION

The above and other beneficial objects and advantages are accomplished in accordance with the present invention by an exercise device comprising:

(a) a rigid framework comprising a bottom portion, opposed upright side portions and a rear portion, (b) a platform mounted upon said bottom portion in centered relationship between said side portions and adapted to rotate in a horizontal plane about a vertical center axis, (c) a stool mounted upon said platform and rotatable therewith, said stool being comprised of an upright support post and seating portion, (d) opposed arm rests of adjustable height supported by said side portions, (e) adjustable handgrips associated with said arm rests, (f) a back rest associated with said rear portion and adjustably positionable with respect to elevation and angle of inclination, and (g) paired foot engaging means disposed upon said platform in opposed relationship about said upright support post.

In preferred embodiments, the upright support of said stool is centered upon said vertical axis. The side portions of the framework may be of tubular construction, enabling the height of the arm rests to be adjusted by a telescoping movement of slidably interengaging components.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
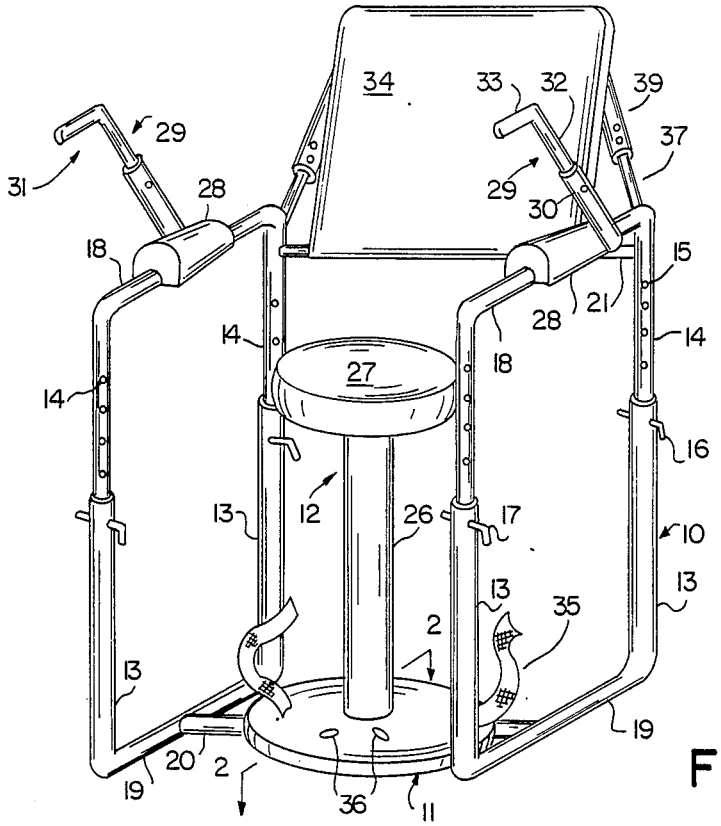
FIG. 1 is a front perspective view of an embodiment of the exercising device of the present invention.
Figure 2:
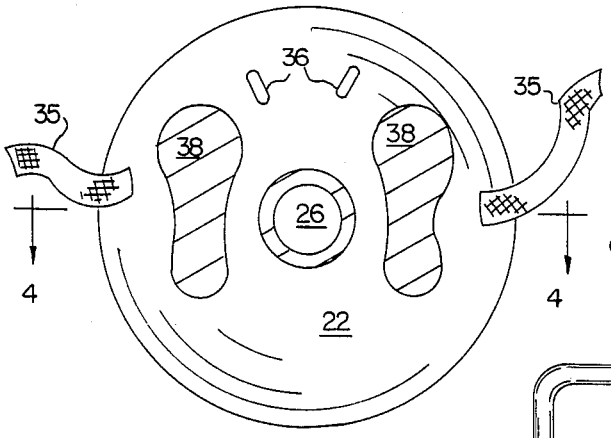
FIG. 2 is an enlarged fragmentary sectional view taken upon the line 2—2 of FIG. 1.
Figure 4:
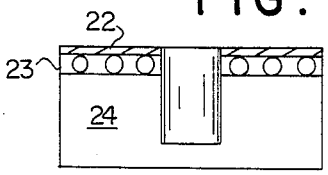
FIG. 4 is a sectional view taken upon the line 4—4 of FIG. 2.
Figure 3:
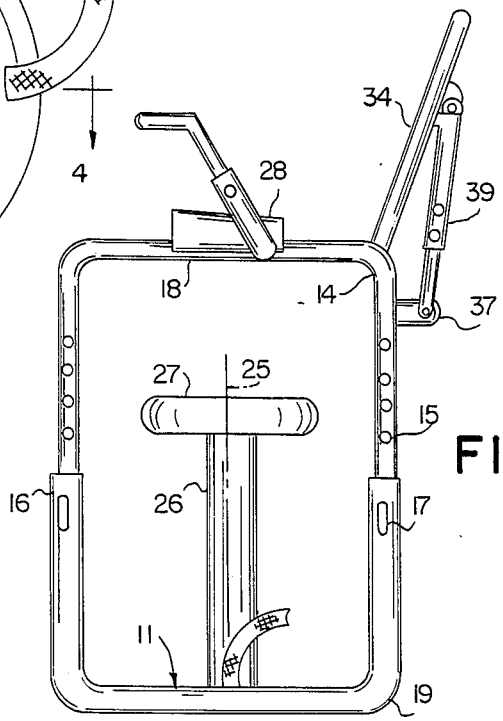
FIG. 3 is a side view.

Referring to FIGS. 1–4, an embodiment of the exercise device of the present invention is shown comprised of framework 10 which embraces rotatable platform 11 and stool 12 mounted upon said platform.

Framework 10 is shown to be of generally tubular construction, having opposed upright side portions comprised of lower tubes 13 and upper rods 14 telescopically positionable within said lower tubes. Rods 14 are provided with a series of apertures 15 that may be aligned with apertures 16 located adjacent the upper extremities of corresponding tubes 13. By inserting a removable locking pin 17 through aligned apertures 15 and 16, the elevation of rods 14 is secured. An upper transverse bar 18 extends between the upper extremities of rods 14. A lower transverse tube 19 extends between the lower extremities of tubes 13. Upper transverse bar 18 and corresponding rods 14 may in fact be fabricated of a single piece of metal rod stock bent to the appropriate shape. Likewise, lower transverse tube 19 and associated tubes 13 may be fabricated of a single piece of metal tube stock bent to appropriate shape.

A bottom portion of framework 10, in the form of connection tube 20 joins said lower transverse tubes 19 at their midpoints A rear portion of framework 10 in the form of upper connecting rod 21 joins opposed rods 14 adjacent their uppermost extremity.

Platform 11, of circular configuration, is mounted upon connecting tube 20 in a manner to rotate in a horizontal plane about vertical center axis 25. As shown more clearly in FIG. 4, the platform is comprised of an upper panel 22 supported by ball bearings 23 above stationary base 24.

Stool 12 is comprised of upright support post 26 rising vertically from upper panel 22 along axis 25, and a seating portion 27 affixed to the upper extremity of said post. The elevation of said seating portion is below upper transverse bars 18. In a preferred embodiment, post 26 may be removable from the platform to facilitate dismantling of the exercise device to a small volume for expeditious storage and shipment.

Arm rests 28 are positioned atop upper transverse bars 18, and accordingly can be positioned at desired elevations. A handgrip 29 is associated with each arm rest The particular construction of handgrips exemplified is comprised of a base tube 30 pivotably attached to the arm rest, and an interior member 31 having a shaft 32 slidably positionable within tube 30 and a handle portion 33 disposed at the free upper extremity of said shaft.

A back rest panel 34 is supported by upper connecting rod 21 in a manner permitting tilting movement in a vertical path. By virtue of its association with connecting rod 21 joined to upper rods 14, the back rest panel can be further positioned with respect to elevation above seating portion 27. The tilted position of back rest panel 34 is secured by means of paired telescoping braces comprised of pivoted upper cylinder 39 and pivoted penetrating post 37. Aligned holes in said cylinder 39 and post 37 permit securement by means of a pin such as locking pin 17.

Paired foot engaging means in the form of straps 35 and interactive buckles 36 are disposed upon upper panel 22 of the platform in opposed relationship about support post 26. In preferred embodiments, the straps or buckles are equipped with resilient features which cause snug fit of the user's feet. Depressions or cups 38 disposed upon panel 22 may also be employed to secure the feet of the user.

In operation, the exercising person will sit upon the stool, 5 adjust the height of the arm rests and disposition of the handgrips to comfortable positions, and will insert his feet into the foot engaging means. A repetitious alternating twisting movement is then initiated where the lower part of the body twists while the upper part of the body remains essentially motionless by virtue of the restraint effected by the handgrips. In such manner, the intensity of the exercise activity is concentrated into the waist region of the user.

Means may be provided to adjust the force required to twist the stool. Electronic monitoring devices may be associated with the exercising device to count and display the rate of twisting movement and calories burned per minute of use.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An exercise device comprising:

(a) a rigid framework comprising a bottom portion, opposed upright side portions and a rear portion, (b) a platform mounted upon said bottom portion in centered relationship between said side portions and adapted to rotate in a horizontal plane about a vertical center axis, (c) a stool mounted upon said platform and rotatable therewith, said stool being comprised of an upright support post and seating portion, (d) opposed arm rests of adjustable height supported by said side portions, (e) adjustable handgrips associated with said arm rests, (f) a back rest associated with said rear portion and adjustably positionable with respect to elevation and angle of inclination, and (g) paired foot engaging means disposed upon said platform in opposed relationship about said upright support post.

2. The device of claim 1 wherein the side portions of the framework are of tubular construction, permitting telescoping vertical movement which adjusts the height of said arm rests.

3. The device of claim 1 wherein said stool is removable from said platform.

4. The device of claim 1 wherein said foot engaging means are comprised of straps and interactive buckles.

* * * * *